United States Patent [19]

Leroy et al.

[11] Patent Number: 4,556,372

[45] Date of Patent: Dec. 3, 1985

[54] POSITIVE DISPLACEMENT MACHINE HAVING IMPROVED DISPLACEMENT CURVE

[75] Inventors: André Leroy, Mons; Jean M. Flamme, Beloeil, both of Belgium

[73] Assignee: Robert Bosch GmbH, Stuttgart, Fed. Rep. of Germany

[21] Appl. No.: 615,473

[22] Filed: May 29, 1984

[30] Foreign Application Priority Data

Jun. 16, 1983 [FR] France ..... 83 10192

[51] Int. Cl.[4] ..... F04C 18/00

[52] U.S. Cl. ..... 418/1; 418/150

[58] Field of Search ..... 418/150, 1, 259

[56] References Cited

U.S. PATENT DOCUMENTS

| | | | |
|---|---|---|---|
| 2,791,185 | 5/1957 | Bohnhoff et al. | 418/150 |
| 3,247,803 | 4/1966 | Halsey | 418/150 |
| 4,432,711 | 2/1984 | Tsuchiya et al. | 418/150 |
| 4,507,068 | 3/1985 | Hayase et al. | 418/150 |

FOREIGN PATENT DOCUMENTS

| | | | |
|---|---|---|---|
| 3229916 | 3/1983 | Fed. Rep. of Germany | 418/150 |
| 2203421 | 5/1974 | France | 418/150 |
| 108484 | 7/1982 | Japan | 418/150 |
| 10190 | 1/1983 | Japan | 418/150 |
| 174102 | 10/1983 | Japan | 418/150 |

*Primary Examiner*—William L. Freeh
*Assistant Examiner*—Paul F. Neils
*Attorney, Agent, or Firm*—Michael J. Striker

[57] ABSTRACT

The invention relates to a positive displacement machine, such as a rotary pump, engine or compressor. This machine has a slotted rotor, sealing elements sliding in the slots and a tubular stator formed with a cylindrical inner surface, the contour line of which is particular. This contour line has a symmetry order $s_S$ and is composed of $s_S$ lobes belonging to a shortened hypertrochoid with a core, the symmetry order of this hypertrochoid being $s_H \neq s_S$, and $s_S$ sealing zones belonging to the contour line of the core of the hypertrochoid. Each lobe has a center point angle $\theta_H$, each sealing zone a center point angle $\theta_c$, $\theta_H$ and $S_H$ being related to $\theta_c$ and $s_S$ by the expressions:

$$\theta_H = (2\pi/s_S - \theta_c$$

and $$s_H/s_S = (\theta_H + \theta_c)/\theta_H.$$

5 Claims, 4 Drawing Figures

POSITIVE DISPLACEMENT MACHINE HAVING IMPROVED DISPLACEMENT CURVE

BACKGROUND OF THE INVENTION

The present invention relates to a positive displacement machine having a particular stroke characteristic, and namely to vane type positive displacement machine which can operate either as a pump or as a motor to convert energy by means of stream of fluid medium.

Vane-type positive displacement machines are known which include essentially the following parts:

a rotary shaft for exchanging mechanical energy;

a cylindrical rotor fixedly mounted on the shaft;

a housing surrounding the rotor, the housing including flanges directed at right angles to the axis of rotation of the rotor, and a tubular body (stator) defining a cylindrical inner surface which is offset relative to the axis of rotation of the rotor;

a plurality of vanes slidably guided in slots of the rotor and engaging the inner surface of the stator in such a manner as to delimit a plurality of variable volume working chambers; and control parts or valves for controlling the intake and discharge of the fluid.

A machine of this kind is described in French Pat. No. 2,203,421, whose particular feature is the shape of the inner surface of the tubular housing. The closed contour line of this inner surface is in the form of a hypertrochoid which can be in theory mechanically generated (a NC machine is in theory not necessary) and can be described by the following complex equation:

$$Z = X + jY = \sum_{k=1}^{n+1} A_k \exp j\,(\alpha_k K + \beta_k)$$

wherein j is imaginary unit, and exp j is imaginary exponential function;

$A_k, \alpha_k, \beta_k$ are real numbers defining parameters of a particular form of the hypertrochoid;

K is a real parameter varying between zero and a particular value K*, where the affix once covers the hypertrochoid;

n is an integer defining the order of the hypertrochoid.

The disadvantage of this known embodiment is the difficulty in providing a sufficient seal between the pressure side and the adjoining suction side between the tubular part of the housing (stator) and the rotor, caused by the fact that the hypertrochoid cannot conform the profile of the rotor over a finite center point angle.

Attempts have already been made to avoid this disadvantage by creating local curve sections which deviate from a hypertrochoid. For instance, (a) the contour line of the stator surface is provided with a circular arc having a smallest possible clearance relative to the profile of the rotor, and conforming this profile over a small angle sufficient for guaranteeing a sufficient sealing action; (b) this circular arc is connected to the rest of the hypertrochoidal contour line of the stator surface by another arc having mostly a form of a circular segment whose center point is evidently offset with respect to the center of the rotor.

This solution has a serious drawback resulting from very disadvantageous development of the curvature along the unavoidable connection arc in the case when the order of symmetry of the hypertrochoid is larger than one. In such a design of the machine the sliding vane has a tendency to retract into the rotor exactly at a point where it is expected to slide out as fast as possible. It has been found that the provision of the before described connection arc becomes even more disadvantageous when the angle formed by the sealing arc is increased. This case occurs particularly in such constructions of positive displacement machines where the sealing vanes are replaced by rollers.

SUMMARY OF THE INVENTION

It is, therefore, a general object of this invention to overcome the aforementioned disadvantage.

More particularly, a first object of this invention is to provide a contour line of the stator surface which improves a sealing action between pressure and suction sides of the machine.

A second object of the invention is to provide, between the sealing zones of the stator profile, working zones belonging to a single hypertrochoid with suitably selected parameters. Hence, this invention preserves the advantages of the hypertrochoidal shape of the stator in the working zones, and for example makes it possible to improve the inertial reaction of the vanes in each position where these vanes have a radial movement. A method of selecting the hypertrochoids of this invention will be explained in detail below.

Given basic parameters are the order of symmetry $s_s$ of the stator contour line of this invention with respect to its center point, and the center point angle $\theta_c(\theta_c \neq 0)$ of each sealing zone.

In a plane curve, an order of symmetry $s_s$ with respect to a point O represents the quality of the curve by which after one revolution with an amplitude $2\pi/s_s$ radians about the point O the curve is brought in coincidence with itself.

In the before mentioned French Pat. No. 2,203,421 the stator curve coincides completely with a hypertrochoid whose order of symmetry $s_H$ is identical with the order of symmetry $s_S$ of the stator curve, the latter being of necessity an integer.

By contrast, the displacement curve according to this invention is a closed hypertrochoid whose order of symmetry $s_H$ differs from the order of symmetry $s_S$ of the stator curve and is expressed by a rational number according to the formula $$s_H = \frac{\theta_c + \theta_H}{\theta_H} \cdot s_S$$

wherein $\theta_H = (2\pi/s_S) - \theta_C$.

The order of symmetry $s_H$ of the hypertrochoid is obtained by a suitable selection of the form parameter $\alpha_k$, as it will be explained below:

(a) One of the parameters $\alpha_k$ is choosen as the reciprocal value $1/s_H$ of $s_H$ and will be designated $\alpha_m$;

(b) the remaining form parameters $\alpha_k$, both positive and negative, differ from $\alpha_m$ by an arbitrary integer.

Other necessary conditions imposed to a hypertrochoid are derived from the following consideration: Every hypertrochoid is contained in a circular ring whose outer circumference circumscribing the hypertrochoid is of necessity real and has a radius $R_e$ which is smaller than or equal to $R_e$*, namely $$R_e^* = \sum_{k=1}^{n+1} A_k,$$

and whose inner circumference has a radius $R_i$ which is greater than or equal to $R_i^*$, namely $$R_i^* = A_m - \sum_{\substack{k=1 \\ k \neq m}}^{n+1} A_k$$

and can be real ($R_i > \phi$), fading ($R_i = \phi$) or imaginary ($R_i < \phi$).

In this invention are only retained those hypertrochoids for which the inner circumference of the ring is real and consequently is inscribed in the hypertrochoid.

It will be noted that in this case the cylindrical hypertrochoid surface of which such a hypertrochoid is the contour line, develops a cylindrical core whose contour line is the inner circumference inscribed in the hypertrochoid. For the sake of simplicity, in the following this particular hypertrochoid type will be designated as a hypertrochoid "with a core."

Further conditions are set according to which the nominal radius $R_i$ of the core of the hypertrochoid is identical with the nominal radius $R_r$ of the rotor, and the radius $R_e$ of the circumscribed circumference of the annular stator equals $$R_e = R_r + H$$

wherein H is the maximum stroke of the vanes.

Furthermore, other necessary conditions for the retained hypertrochoids according to this invention result from following requirements:

no retrogression of the curve may be present at its contacts both with the circumscribed and the inscribed circumferences of the ring which contains it, whereby "ordinary" hypertrochoids are to be eliminated (the words "ordinary", "prolongated", "shortened" have the same meaning for hypertrochoids as for trochoids);

at any point of a retained hypertrochoid, an invariable sign of the ratio $d\rho/dK$ is to be maintained, the polar angle being computed from the expression:

$$\mathrm{tg}\rho = I_{m(Z)}/R_e(Z)$$

This second condition eliminates the "prolongated" hypertrochoids.

Consequently, the only retained hypertrochoids are "shortened" hypertrochoids, the selection of which follows of necessity from the numerical evaluation of the aforementioned affix, Z for all possible values of the parameter K between zero and $K^*$.

In practice, by means of this method, implicit limitations are imposed on the selection of form parameters $A_k$ and $\beta_k$, but it stands to reason that a sufficient set of parameters is always available to realize an optimized shape of the stator surface, for example to minimize the effect of inertial forces, as the order of n of the hypertrochoid can be freely selected.

In summary, the hypertrochoids used in this invention are shortened hypertrochoids with a core the symmetry order of which is a rational but not an integer number.

That part of the hypertrochoid with a core, which is limited by two consecutive contact points with its core, will be designated as a "lobe".

The stator curve according to this invention is composed of $s_S$ such defined lobes, the center point angle of which is $\phi_H$ and of $s_S$ sealing zones belonging to the contour line of the core.

It will be noted that the first "lobe" can be arbitrarily selected on the retained hypertrochoid, and that a sealing zone adjoins this lobe so that its other end coincides with the beginning of the following lobe, etc., until the beginning of the first lobe is reached.

It is also important to note that a stator curve according to this invention has an order of symmetry $s_S$ relative to its center point O without having of necessity any symmetry with respect to an arbitrary straight line passing through the center point.

It is deemed also necessary to point out the fact that in contrast to the stator surface proposed in the aforementioned French Pat. No. 2,203,421, the stator surfaces of this invention cannot be mechanically generated (a numerical control machine is necessary).

As the hypertrochoids used in this invention have not yet been proposed nor used for any technical application: other restrictions about the selection of the form parameters besides these which have been mentioned hereover, restrictions about the selection of the order n of the hypertrochoid, are not to be imposed; specially shortened basic hypertrochoids, the order of which is n=1, are in the scope of this invention, provided that their symmetry order is a rational but not an integer number.

Machines, the stator curve of which is a curve constructed at a uniform distance from a curve composed of $s_S$ lobes belonging to a shortened hypertrochoid with a core, the symmetry order of which is a rational but not an integer number, and of $s_S$ arcs belonging to the contour line of the core of this hypertrochoid, are also in the scope of this invention.

Since the stator curves of this invention permit the provision of sealing zones including without disadvantages relatively large center point angles, it is also possible to use such a stator curve in machines the sealing elements of which are rollers instead of vanes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
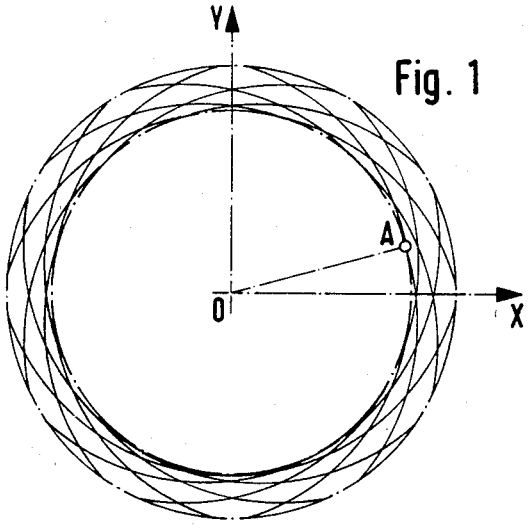
FIG. 1 shows a special case of a hypertrochoid suitable for use in the machine of this invention.
Figure 2:
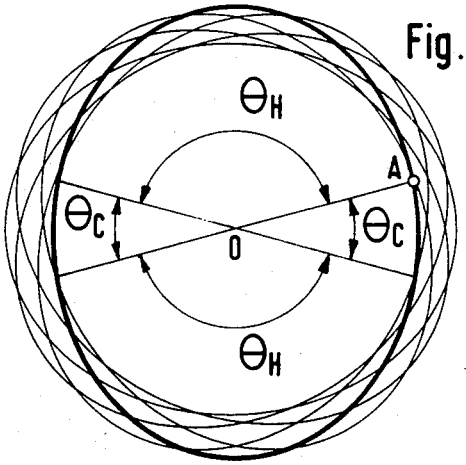
FIG. 2 is a stator surface in the machine of this invention.

Referring firstly to FIG. 1 the shown hypertrochoid has been drawn in accordance with the before described considerations for constructing a stator surface in the machine of this invention. The contour curve of the stator surface as illustrated in FIG. 2 has the order of symmetry $s_S=2$ and defines sealing zones including an imposed angle $\theta_c=30°$. Accordingly, the angle of working spaces is $\theta_H=150°$ and $$s_H=(180/150)\times 2=12/5$$

It has been assumed in advance to select a hypertrochoid of the order n=2 which meets the following equation:

$$Z=\sum_{k=1}^{3} A_k \exp j\,(\alpha_k \cdot K+\beta_k).$$

In agreement with the foregoing considerations, $$\alpha_m=\alpha_2=1/s_H=5/12, \text{ and}$$

by taking arbitrary integers equal to ±1 there results $$\alpha_1=\alpha_2-1=7/12$$

$$\alpha_3=\alpha_2 1=17/12$$

Provided that there is no need for optimizing the stator curve to a specific technical requirement, then the relations $$A_1=A_3$$

$$R_r+H=A_2+2A_1$$

$$R_r=A_2-2A_1$$

are applicable, from which $A_1$, $A_2$ and $A_3$ are derived.

The values of $\beta_k$ are determined so that the polar angle corresponding to the contact point A of the first lobe with the core be equal to 15°.

Hence:

$$Z_A=R_r \exp j(15°)$$

$$A_A=A_2 \exp j(15°)+2A_i \exp j(180°+15°)$$

and it results $$\beta_2=15°$$

$$\beta_1=\beta_3=195°.$$

In this manner, the hypertrochoid of FIG. 1 is fully defined and it can be seen that it has twelve lobes and that it closes on itself after five rotations.

Figure 3:
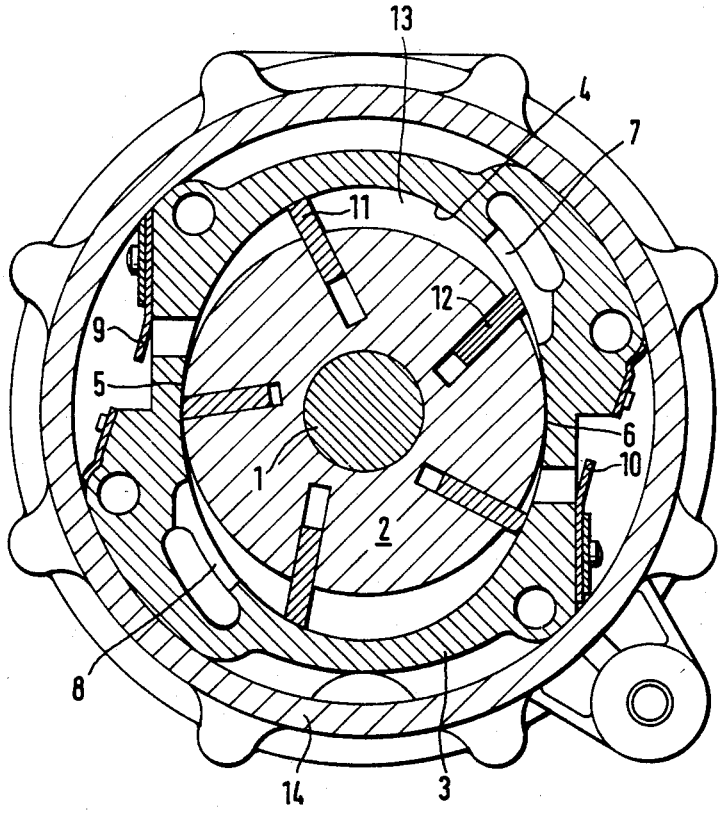
FIG. 3 illustrates schematically a sectional view of a compressor constructed in accordance with this invention.
Figure 4:
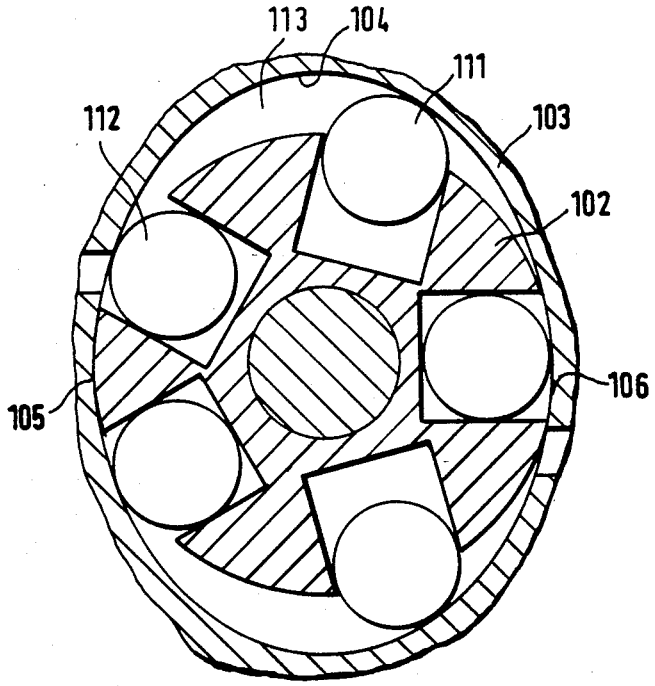
FIG. 4 is a modification of the device of FIG. 3.

The stator contour line of FIGS. 2–4 is constructed in accordance with this invention from the hypertrochoid of FIG. 1 on which point A has been choosen as the starting point.

The construction of a hypertrochoid with a core as a displacement curve for a vane-or roller-type machine starts with the preliminary selection of the before discussed design parameters $S_s$-the order of symmetry of the displacement curve;

$\theta_c$-the center point angle of each sealing arc;

$R_r$-the rotor radius; and

H-the maximum stroke of the sealing elements.

These design parameters completely define two basic hypertrochoids, the order of which is n=1.

One of these basic hypertrochoids tends to increase the displacement but leads to a relatively important lateral component of the acceleration at the center of gravity of each sealing element; on the contrary, the other basic hypertrochoid tends to reduce the displacement, but leads to a relatively small lateral component of the aforesaid acceleration.

EXAMPLE

Assuming the following preliminary selection of design parameters:

$S_s=2$ $\theta_c=30°$ $R_r=30$ mm

H=6 mm (1)

and by applying the method of this invention, one can immediately compute the values of $\theta_H$ and of $s_H$:

$$\theta_H=\frac{2\pi}{s_S}-\theta_c=150°$$

$$S_H=\frac{\theta_c+\theta_H}{\theta_H}\cdot s_S=\frac{12}{5}$$

These values characterize all the hypertrochoids with a core which can be used to define the displacement curve of a machine corresponding to the preliminary design parameters (1).

Among all these hypertrochoids, two are already completely determined: they are the two "basic" hypertrochoids the order of which is equal to one (n=1).

In the cartesian axis system OXY, these basic hypertrochoids satisfy the equation:

$$Z_b=A_1 \exp j(\alpha_1 K+\beta_1)+A_2 \exp j(\alpha_2 K+\beta_2)$$

where $$A_1=R_r+(H/2)$$

$$A_2=H/2$$

$$\alpha_1=1/S_H=12/5$$

$$\beta_1=\theta_c/2=15°$$

$$\beta_2=(\theta_c/2)+\pi=195°$$

The two basic hypertrochoids are distinguishable by the corresponding values of $\alpha_2$. For the basic hypertrochoid ($Z_{b1}$) which tends to increase the displacement, $$\alpha_2=\alpha_1+1=17/5; \text{ and}$$

for the other basic hypertrochoid ($Z_{b2}$), $$\alpha_2=\alpha_1-1=7/5.$$

In summary, the construction of a displacement curve according to the invention includes the following steps:

1. Lay a cartesian axis system OXY;
2. Draw the core (a circle, the center of which is the point O and the radius of which is $R_r$);
3. Lay a sealing arc, the center point angle of which is $\theta_c$; (This sealing arc has to be laid symmetrically with regard of the OX axis);
4. Locate the point A at the end of the sealing arc which is in the first gradrant;
5. Locate, if necessary, on the core, the other sealing arcs by repeating the first arc with an angular shift $2\pi/s_s$;
6. Compute the co-ordinates X and Y of the points of the hypertrochoid with increasing values of K (starting from K=0), until coming back to point A; and 7. Retain the only lobes the extremities of which coincide with those of the sealing arcs (i.e. these lobes together with the sealing arcs make up the displacement curve).

An examplary embodiment of a machine of this invention is shown in FIG. 3 illustrating a rotary compressor employing the stator contour line of FIG. 2. The compressor includes a driving shaft 1 rigidly connected to a cylindrical slotted rotor 2. The rotor is driven for rotation in a tubular stator housing 3 whose inner surface contour 4 corresponds to the before described hypertrochoid with a core, the latter defining the sealing zones 5 and 6. The stator housing 3 is formed with inlet ports 7 and 8 and is provided with pressure valves 9 and 10. Five sealing elements in the form of vanes 11 and 12 are slidably arranged in the slots of the rotor 2 and engage the stator surface 4 to delimit together with the stator and the rotor variable volume working chambers such as 13. The stator housing 3 is installed in an outer housing 14.

In a modification, the sealing elements are in the form of rollers 11', as illustrated in FIG. 4.

FIG. 4 illustrates a modification of a rotary compressor of FIG. 3.

Tubular stator housing 103, inner contour 104 of the housing and sealing zones 105 and 106 have the same configuration as the corresponding elements in FIG. 3. The five sealing elements however, are in the form of rollers 111 and 112 movably arranged in rectangular slots of the rotor 102. The rollers 111 and 112 delimit variable volume working chambers 113 similarly as in the preceding example.

It will be understood that each of the elements described above, or two or more together, may also find a useful application in other types of constructions differing from the type described above.

While the invention has been illustrated and described as embodied in a positive displacement compressor, it is not intended to be limited to the details shown, since various modifications and structural changes may be made without departing in any way from the spirit of this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A positive displacement machine having a shaft, a slotted rotor fixed on the shaft, a tubular stator formed with a cylindrical inner stator surface surrounding the slotted rotor, and sealing elements sliding in the slots of the rotor to engage the stator surface and to delimit therewith a plurality of working chambers, said stator surface having a contour line the order of symmetry of which is an integer number $s_S$, this contour line being composed of $s_S$ lobes belonging to a single shortened hypertrochoid with a core, the order of symmetry of which is a rational number $S_H$, and of $s_S$ sealing zones belonging to the contour line of the core of this hypertrochoid, each lobe having a center point angle $\theta_H$ and each sealing zone having a center point angle $\theta_c$, $\theta_H$ being related to $\theta_c$ and $s_S$ by the expression:

$$\theta_H=(2\pi/s_S)-\theta_c$$

and $$S_H/s_S=\theta_H+\theta_c/\theta_H.$$

2. A machine as defined in claim 1 wherein the contour line of the stator surface is a curve constructed at a uniform distance from a contour line according to claim 1.

3. A machine as defined in claim 1 or 2, wherein said sealing elements are sliding vanes.

4. A machine as defined in claim 1 or 2, wherein said sealing elements are rollers.

5. A method of constructing a displacement curve for a vane-type or a roller-type positive displacement machine having a rotor, a plurality of sealing elements slidably arranged on said rotor to engage the displacement curve at sealing arcs thereof, comprising the steps of preselecting an order of symmetry $s_S$ of the displacement curve, a center point angle $\theta_c$ of each sealing arc, a rotor radius $R_r$, and a maxmimum stroke H of the sealing elements; then determining a contour line of the displacement curve which is composed of $s_S$ lobes belonging to a hypertrochoid with a core, each lobe having a center point angle $\theta_H$ corresponding to the expression $$\theta_H=(2\pi/s_S)-\theta_c, \text{ and}$$

the order of symmetry $s_H$ of the hypertrochoid with a core corresponding to the expression $$S_H=\theta_H+\theta_c-s_S/\theta_H$$

* * * * *